United States Patent [19]

King

[11] Patent Number: 4,941,538

[45] Date of Patent: Jul. 17, 1990

[54] ONE-PIECE DRILL BIT WITH IMPROVED GAGE DESIGN

[75] Inventor: William W. King, Spring, Tex.

[73] Assignee: Hughes Tool Company, Houston, Tex.

[21] Appl. No.: 409,706

[22] Filed: Sep. 20, 1989

[51] Int. Cl.[5] ..... E21B 10/46

[52] U.S. Cl. ..... 170/329; 175/410

[58] Field of Search ..... 175/329, 409, 410, 393

[56] References Cited

U.S. PATENT DOCUMENTS

| | | | |
|---|---|---|---|
| 4,140,189 | 2/1979 | Garner | 175/329 |
| 4,246,977 | 1/1981 | Allen | 175/329 |
| 4,545,441 | 10/1985 | Williamson | 175/329 |
| 4,640,375 | 2/1987 | Barr et al. | 175/410 |
| 4,696,354 | 9/1987 | King et al. | 175/329 |

FOREIGN PATENT DOCUMENTS

| | | | |
|---|---|---|---|
| 2190412 | 5/1986 | United Kingdom | 175/329 |

*Primary Examiner*—William P. Neuder

*Attorney, Agent, or Firm*—Charles D. Gunter, Jr.

[57] ABSTRACT

A one-piece drill bit is shown for use in drilling a borehole in an earthen formation. The bit includes a body having a face on one end and a shank on the opposite end. The face has a noise and a gage region. The gage region is bisected between an upper and lower stabilizing regions of full gage diameter cutter elements. An intermediate undercut region minimizes contact with the borehole wall while maintaining an effective gage length for the bit.

6 Claims, 3 Drawing Sheets

PRIOR ART

ONE-PIECE DRILL BIT WITH IMPROVED GAGE DESIGN

BACKGROUND OF THE INVENTION

1. Field of the Invention

The present invention relates to earth boring bits of the type used to drill oil and gas wells.

2. Description of the Prior Art

The prior art earth boring bits include the rolling cutter bits, having either steel teeth or tungsten carbide inserts, and diamond bits which utilize either natural diamonds or artificial or man-made diamonds. The diamond earth boring bits have one-piece bodies of either steel or matrix. The steel body bits are machined from a steel block and typically have cutting elements which are press-fit into recesses provided in the bit face. The matrix bit is formed by coating a hollow tubular steel mandrel in a casting mold with metal bonded hard material, such as tungsten carbide. The casting mold is of a configuration which will give the bit a desired form. The cutting elements are typically either polycrystalline diamond compact cutters braised within a recess provided in the matrix backing or are thermally stable polycrystalline diamond or natural diamond cutters which are cast within recesses provided in the matrix backing.

The single-piece bit is finding increased applications in both directional drilling and the drilling of sticky formations. One problem encountered in designing a one-piece bit is that the gage region, i.e. the uppermost end as viewed during drilling, exhibits a great deal of wear in directional and high speed drilling applications. The prior art techniques for design of the gage region of the one-piece bit have typically been of two schools of thought. The first has been to build full API gage sections with a high percentage of contact with the borehole wall. The second approach has been to undersize the upper gage region to limit wall contact in sticky formations. Neither of these techniques has proved entirely satisfactory. Full gage sections can create torquing problems, sticking and less than optimum directional characteristics. Short, full gage sections backed up by undersized lands can go undersize, cause deviation and allow unacceptable bit wobble. If unchecked, the rapid wear of the gage region and resulting wobble of the bit can cause the cutting structures to wear prematurely, limiting the useful life of the bit.

An object of the present invention is to increase the effective gage length of a single-piece bit without increasing the total wall contact area.

Another object of the invention is to provide a bit with an effective gage length having cutting elements at the top and bottom of the gage with an intermediate undercut region which reduces drag and improves the stability of the bit.

Another object of the invention is to provide a single-piece bit with changeable directional characteristics.

Additional objects, features and advantages will be apparent in the written description which follows.

SUMMARY OF THE INVENTION

The single-piece drill bit of the invention is used for drilling a borehole in an earthen formation. The bit includes a body having a bit face on one end and a shank on the opposite end with means for connection to a drill string for rotation about a longitudinal axis. The bit face has a nose and a gage region, the gage region terminating in a shoulder adjacent the bit shank. An upper stabilizing region of full gage diameter cutter elements is positioned adjacent the bit shoulder. A lower stabilizing region of full gage diameter cutter elements is spaced axially on bit face from the upper stabilizing region. An undercut region is located on the bit face between the upper and lower stabilizing regions. The undercut region is selectively sized to minimize contact with the borehole wall, thereby maintaining an effective gage length for the bit without increasing the total contact area of the bit face with the wall of the borehole being drilled.

DETAILED DESCRIPTION OF THE INVENTION

Figure 1:
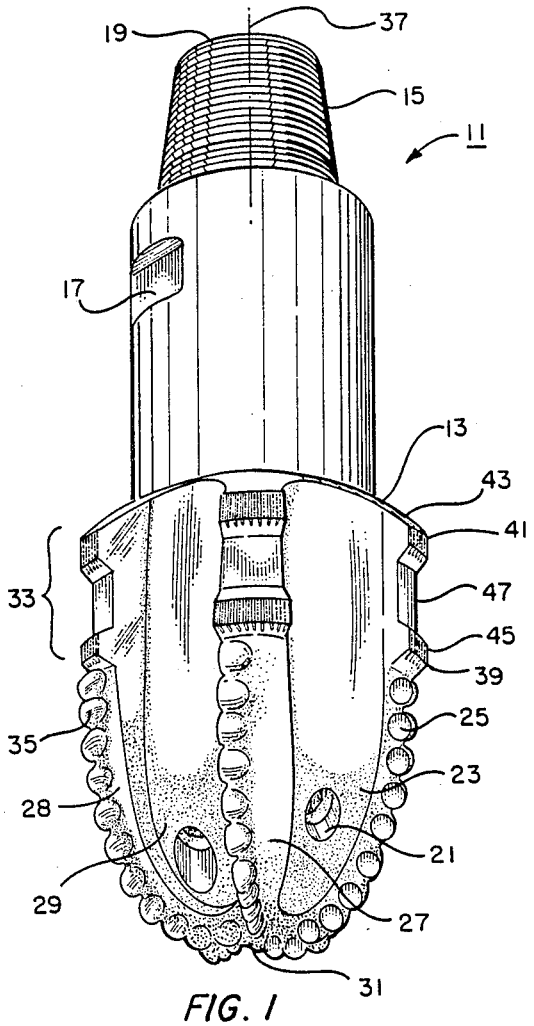
FIG. 1 is a perspective view of a bit of the invention showing the improved gage design.

FIG. 1 shows an earth boring bit of the invention designated generally as 11. The bit 11 includes a body 13 with a threaded shank 15 formed on one end for connection with a drill string member (not shown). The body 13 also includes a pair of wrench flats 17 which are used to apply the appropriate torque to properly "make-up" the threaded shank 15. The body 13 has a tubular bore 19 which communicates with the interior of the drill string member, and which communicates by internal fluid passageways (not shown) with one or more fluid openings 21 which are used to circulate fluids to the bit face.

On the opposite end of the bit body 13 from the threaded shank 15 there is formed a bit head or "matrix" 23 in a predetermined configuration to include cutting elements 25, longitudinally extending lands 27, 28 and fluid courses or void areas 29. The matrix 23 is of a composition of the same type used in conventional diamond matrix bits, one example being that which is disclosed in U.S. Pat. No. 3,175,629 to David S. Rowley, issued Mar. 30, 1965. Such matrices can be, for example, formed of copper-nickel alloy containing powdered tungsten carbide.

Matrix head bits of the type under consideration are manufactured by casting the matrix material in a mold about a steel mandrel. The mold is first fabricated from graphite stock by turning on a lathe and machining a negative of the desired bit profile. Cutter pockets are then milled in the interior of the mold to the proper contours and dressed to define the position and angle of the cutters. The fluid channels and internal fluid passageways are formed by positioning a temporary displacement material within the interior of the mold which will later be removed.

A steel mandrel is then inserted into the interior of the mold and the tungsten carbide powders, binders and flux are added to the mold. The steel mandrel acts as a ductile core to which the matrix material adheres during the casting and cooling state. After firing the bit in a furnace, the mold is removed and the cutters are mounted on the exterior bit face within recesses in or receiving pockets of the matrix.

Figure 2:
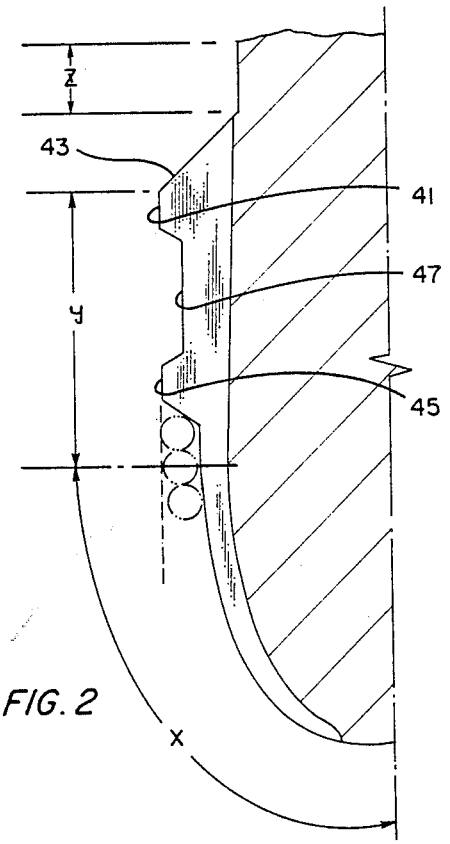
FIG. 2 is a simplified, schematic view of a section of the bit of FIG. 1 showing the profile of the gage section.

The earth boring bit of FIG. 1 has a ballistic or "bullet-shaped" profile which increases in external diameter between the nose 31 and the gage region 33 of the bit. Referring to FIG. 2, the face region of the bit extends generally along the region "X", the gage region extends generally along the region "Y", and the shank extends generally along the region "Z". The bit is generally conical in cross-section and converges from the gage region "Y" to the nose 31. By "gage" is meant the point at which the bit begins to cut the full diameter. That is, for an 8½ inch diameter bit, this would be the location on the bit face at which the bit would cut an 8½ inch diameter hole.

As shown in FIG. 1, each fluid course 29 comprises a groove of lesser relative external diameter located between two selected lands (27, 28 in FIG. 1) on the bit face. The lands 27, 28 have polycrystalline diamond cutter elements 25 mounted therein within backings of the matrix for drilling the earthen formations. The backings 35 for the cutting elements 25 are portions of the matrix which protrude outwardly from the face of the bit and which are formed with cutter receiving pockets or recesses during the casting operation.

The cutting elements 25 are of a hard material, preferably polycrystalline diamond composite compacts. Such cutting elements are formed by sintering a polycrystalline diamond layer to a tungsten carbide substrate and are commercially available to the drilling industry from General Electric Company under the "STRATAPAX" trademark. The compact is mounted in the recess provided in the matrix by braising the compact within the recess. The preferred cutting elements 25 are generally cylindrical.

As shown in FIG. 1, each land 27, 28 is formed as a convex ridge of the matrix material which extends from the nose 31 outwardly in an arcuate path, the path gradually transitioning to extend generally longitudinally along the bit axis 37 to terminate in a bisected planar pad at the gage region 33 of the bit. The bisected planar pad includes an upper stabilizing region 41 adjacent the bit shoulder 43. The upper stabilizing region 41 has small diamonds (polycrystalline and/or natural) embedded in the surface thereof and has longitudinal troughs which extend generally parallel to the longitudinal axis 37 of the bit.

By "upper" is meant in the direction of the shank 15 when the bit body is viewed in the drilling position shown in FIG. 1.

The bisected planar pad also includes a lower stabilizing region 45 of full gage diameter cutter elements, similar to upper region 41. The lower region 45 is spaced-apart axially on the bit face from the upper stabilizing region 41. The upper and lower stabilizing regions 41, 45 are separated by an undercut region 47. Undercut region 47 has a greater relative external diameter than the grooves 29 but a lesser relative external diameter than the bisected pad regions 41, 45. The undercut region 47 is selectively sized to minimize contact with the borehole wall, thereby maintaining an effective gage length for the bit 13 without increasing the total contact area of the bit face with the wall of the borehole being drilled.

Figure 3:
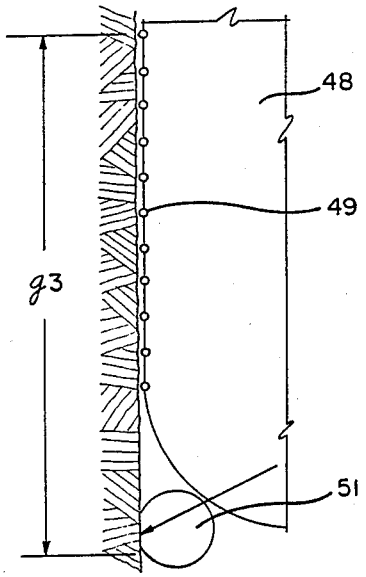
FIGS. 3–6 are simplified schematic views of the prior art gage designs.

This concept is best illustrated schematically with respect to FIGS. 3–9 of the drawings. FIGS. 3–6 illustrate the prior art concepts for controlling gage wear and dealing with sticky formations. FIG. 3 is a schematic view of a cast matrix bit 48 using the standard approach where diamonds 49 are embedded in the matrix to the full API gage diameter. PDC cutters are mounted at the bit "heel" to the full API gage diameter.

Figure 4:
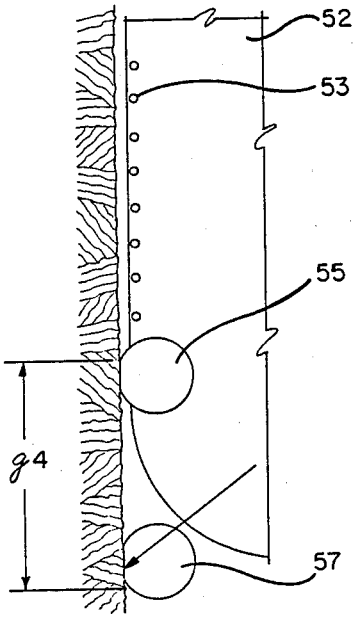

FIG. 4 shows a prior art matrix bit 52 of the type used in sticky formations in which flush set diamonds 53 are built undersized to limit wall contact. PDC cutters 55, 57 are mounted at full API gage diameter.

Figure 5:
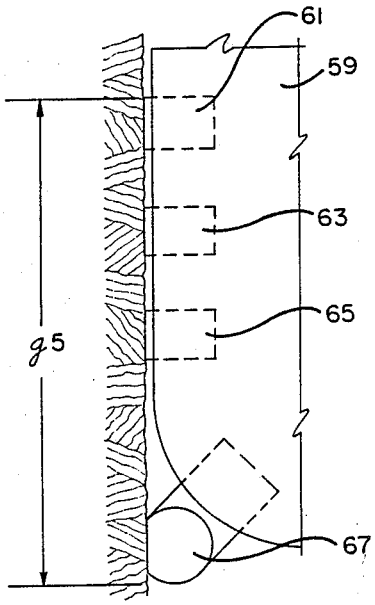
Figure 6:
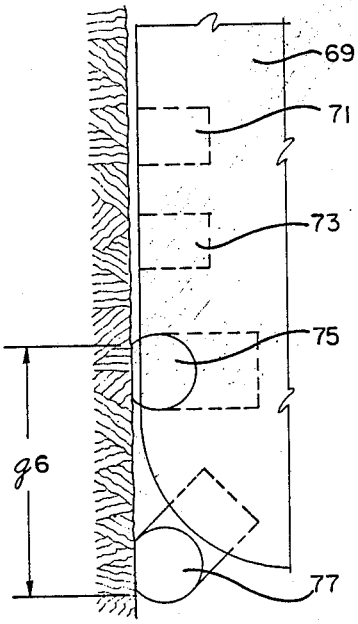

FIG. 5 shows a prior art steel bodied PDC bit 59 utilizing a standard approach in which tungsten carbide compacts 61, 63, 65 are pressed into the bit body to the full API gage diameter. A PDC stud 67 is pressed in to the bit body to the full API gage diameter FIG. 6 shows a prior art approach for sticky formations utilizing a steel bodied bit 69. Tungsten carbide compacts 71, 73 are pressed in undersize to limit wall contact. PDC studs 75, 77 are pressed in to the bit body to full API gage diameter. In each case, the effective gage length of the prior art approach is illustrated as "$g_3$"–"$g_6$".

Figure 7:
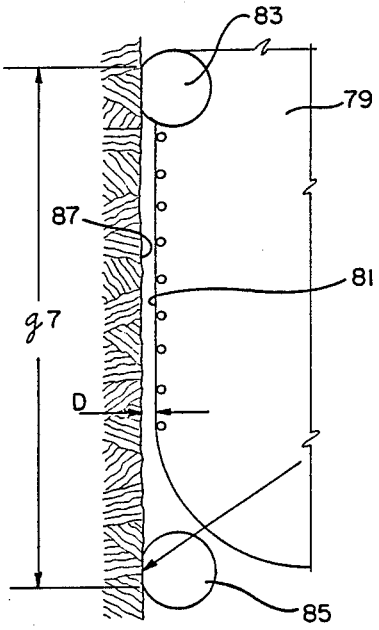
FIGS. 7–9 are simplified schematic views of the gage designs of the invention showing the placement of the cutter elements.
Figure 9:
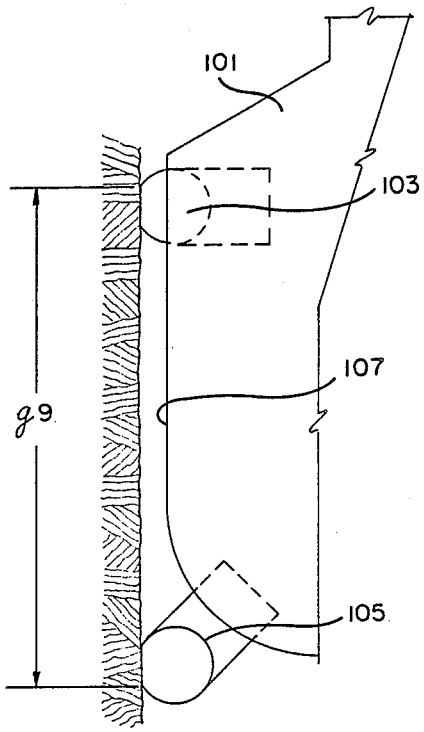
Figure 8:
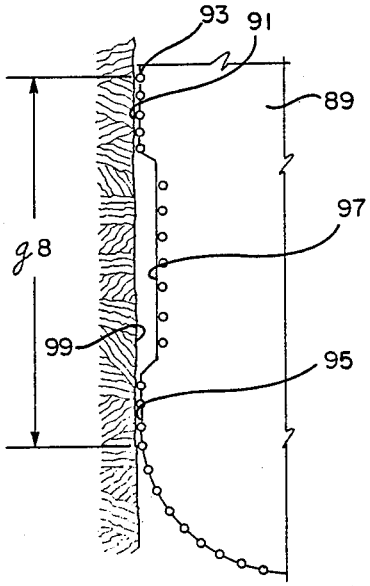

FIGS. 7–9 illustrate the novel approach of the invention in which an upper stabilizing region and lower stabilizing region of full gage diameter cutter elements are separated by an intermediate undercut region. FIG. 7 shows a cast matrix bit 79 having an undercut region 81 which is undersized to limit wall contact and allow clearance for steering of the bit. PDC cutters 83, 85 are mounted to the full API gage diameter on either side of the undercut region 81. The circumferentially spaced cutters 83 form an "outrigger" which minimizes contact with the borehole wall 87. The undercut region 81 is thus spaced-apart from the borehole wall 87 by a diameter "D" which is typically 2 to 3 times greater than the spacing of the prior art approaches.

FIG. 8 shows a natural diamond bit 89 having an upper stabilizing region 91 with natural diamonds 93 embedded therein, a lower stabilizing region 95, and an intermediate undercut region 97. The undercut region 97 is intentionally undersized to minimize wall contact with the surrounding borehole wall 99. The upper and lower regions 91, 95 are sized to the full API gage diameter.

FIG. 9 shows a steel bodied PDC bit 101 having PDC studs pressed in to the full gage diameter at the top stabilizing region 103 and the lower stabilizing region 105. The upper and lower regions are separated by an undersized region 107. The effective gage length is indicated in each of the bits of the invention as "$g_7$"–"$g_9$".

An invention has been provided with several advantages. The novel gage design of the invention provides an overall gage length which equals or exceeds the gage length of the prior art designs, while at the same time minimizing wall contact with the surrounding borehole. As a result, gage wear is reduced, thereby decreasing the tendency of the bit to "wobble" and prolonging bit life. By placing an "outrigger" of full gage diameter stabilizing and cutting elements high on the gage lands above an intermediate undercut section, bit wobble is limited and borehole sticking problems are often solved. By varying the differential between the full gage diameter and the undersized diameters of the stabilizing and undercut regions, the bit manufacturer can fine-tune the directional drilling characteristics of one-piece bits. In this manner, controlled steering possibilities are provided which were not available in the prior art.

While the invention has been shown in only one of its forms, it is not thus limited but is susceptible to various changes and modifications without departing from the spirit thereof.

I claim:

1. A single piece drill bit for use in drilling a borehole in an earthen formation, comprising:

a body including a solid bit face on one end and a shank on the opposite end with means for connection to a drill string for rotation about a longitudinal axis, the bit face increasing in external diameter between a nose and a gage region, the gage region terminating in a shoulder adjacent the bit shank;

an upper stabilizing region of full gage diameter cutter elements positioned adjacent the bit shoulder in the gage region of the bit;

a lower stabilizing region of full gage diameter cutter elements spaced apart axially on the bit face from the upper stabilizing region, the lower stabilizing region also being in the gage region of the bit;

an undercut region located on the bit face between the upper and lower stabilizing regions, the undercut region being selectively sized to minimize contact of the gage region with the borehole wall, thereby increasing the effective gage length of the bit without increasing the total contact area of the bit face with the wall of the borehole being drilled.

2. A single piece dirll bit for use in drilling a borehole in an earthen formation, comprising:

a body including a solid bit face on one end and a shank on the opposite end with means for connection to a drill string for rotation about a longitudinal axis, the bit body having a tubular bore which communicates with an interior bore of the drill string for circulation of fluids, the bit face increasing in external diameter between a nose and a gage region, the gage region terminating in a shoulder adjacent the bit shank;

a plurality of fluid openings communicating the bit face with the tubular bore for circulating fluid to the bit face;

a plurality of fluid courses on the bit face extending from the fluid openings, each fluid course comprising a groove of lesser relative external diameter located between two lands of greater relative external diameter on the bit body, the lands having cutter elements mounted therein for drilling the earthen formation;

an outrigger of full gage diameter cutter elements positioned circumferentially about the gage region in the lands adjacent the shoulder;

an undercut region of lesser relative external diameter in the gage region of each of the lands beneath the outrigger;

a heel region of full gage diameter cutter elements positioned circumferentially about the gage region in the lands beneath the undercut region, the diameter of the undercut region being selected to lessen contact of the gage region with the wall of the borehole being drilled, whereby the undercut region increases the effective gage length of the bit without increasing the total contact area of the bit face with the wall of the borehole.

3. The drill bit of claim 2, wherein the face region of the bit is formed in a ballistic shape and wherein the lands begin as convex ridges extending from the nose and terminate in planar pads at the gage region.

4. The drill bit of claim 3, wherein the lands begin at a central location on the bit face and extend outwardly and upwardly in the direction of the shank with each land spaced circumferentially from the next adjacent land.

5. The drill bit of claim 4, wherein the bit face is formed of a cast matrix material and wherein the lands have polycrystalline diamond cutter elements mounted therein within backings of the matrix for drilling the earthen formation.

6. A single piece, matrix bit for use in drilling a borehole in an earthen formation, comprising:

a body including a solid bit face on one end formed from a cast matrix material bonded to a metallic shank on the opposite end with means for connection to a drill string for rotation about a longitudinal axis, the bit body having a tubular bore which communicates with an interior bore of the drill string for circulation of fluids, the bit face increasing in external diameter between a nose and a gage region and terminating in a shoulder adjacent the bit shank, the face of the bit being formed in a ballistic shapeng formed in a ballistic shape, wherein the lands begin as convex ridges extending from the nose to terminate in planar pads at the gage region;

a plurality of fluid openings communicating the bit face with the tubular bore for circulating fluid to the bit face;

a plurality of fluid courses on the bit face extending from the fluid openings, each course comprising a groove of lesser relative external diameter located between two lands of greater relative external diameter on the bit body, the lands having polycrystalline diamond cutter elements mounted therein with backings of the matrix for drilling the earthen formation;

an outrigger of full gage diameter cutter elements positioned circumferentially about the gage region in the lands adjacent the shoulder;

an undercut region of lesser relative external diameter in the gage region of each of the lands beneath the outrigger;

a heel region of full gage diameter cutter elements positioned circumferentially about the gage region in the lands beneath the undercut region, the diameter of the undercut region being selected to lessen contact of the gage region with the wall of the borehole being drilled, whereby the undercut region increases the effective gage length of the bit without increasing the total contact area of the bit face with the wall of the borehole, and whereby the full gage diameter cutter elements, undercut region and heel region together form a bisected planar pad in the gage region of the bit.

* * * * *